United States Patent [19]

Cochran

[11] Patent Number: 4,724,792

[45] Date of Patent: Feb. 16, 1988

[54] MODULAR RIGID INFLATABLE BOAT STRUCTURE

[76] Inventor: William H. Cochran, 1 Williams Street, P.O. Box 32, Stonington, Conn.

[21] Appl. No.: 850,023

[22] Filed: Apr. 10, 1986

[51] Int. Cl.[4] ..... B63B 7/00

[52] U.S. Cl. ..... 114/345

[58] Field of Search ..... 114/345, 346, 354, 356; 441/40–42

[56] References Cited

U.S. PATENT DOCUMENTS 3,261,038 7/1966 Klepper ..... 114/345

FOREIGN PATENT DOCUMENTS 2495096 6/1982 France ..... 441/40

2794 10/1905 United Kingdom ..... 114/348

*Primary Examiner*—Joseph F. Peters, Jr.

*Assistant Examiner*—Jesû D. Sotelo

*Attorney, Agent, or Firm*—Cushman, Darby & Cushman

[57] ABSTRACT

A boat of the type having a rigid hull portion is provided about the periphery thereof with a slotted retaining channel for receiving a first boltrope of a shroud which is provided on an opposite edge with a second, parallel boltrope; a plurality of individual slotted channel segments are attachable to the second boltrope and releasably attachable to the interior of the hull; inflatable bladders are disposed in and retained by the shroud.

30 Claims, 9 Drawing Figures

Fig. 1.
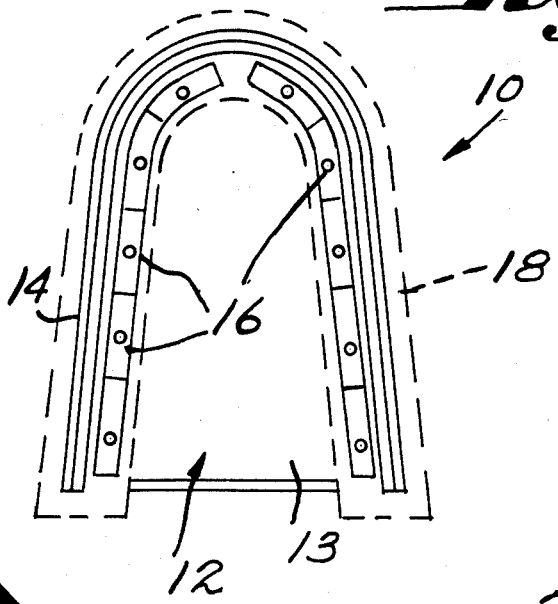
Fig. 3A.
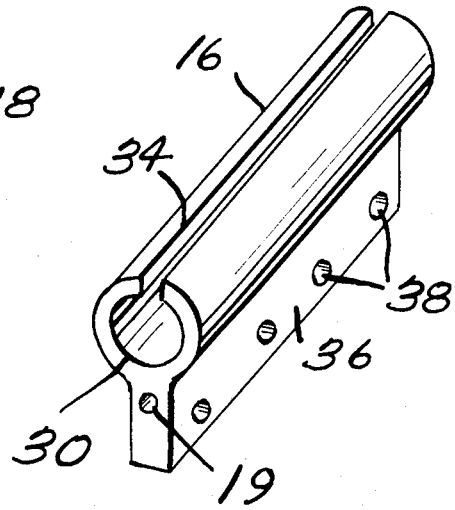
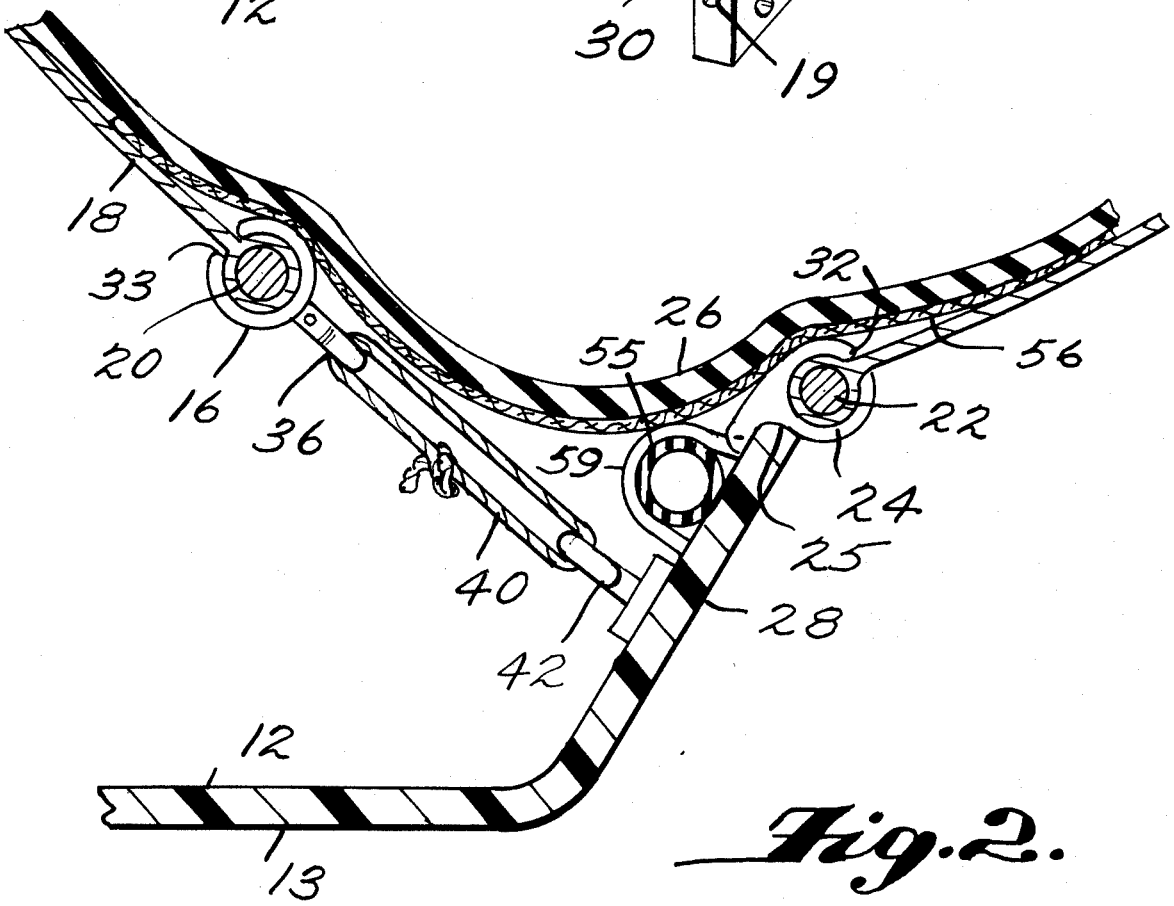
Fig. 2.

MODULAR RIGID INFLATABLE BOAT STRUCTURE

BACKGROUND AND SUMMARY OF THE INVENTION

The present invention relates to an improved construction of a modular rigid inflatable aquatic vessel, and, specifically, to such a structure that will greatly facilitate assembly and disassembly while retaining most, if not all, of the advantages of hitherto-proposed structures of this type. In addition, the structure of the invention will provide greater design flexibility in that the shape of the inflated shroud, tube or collar may be more varied and better economy of material because the stresses on the attachment means of the shroud, tube or collar to the rigid hull module may be more widely distributed by providing as described below.

A number of inflatable aquatic vessels have been proposed in this art and a number developed for use in naval, commercial and recreational applications. One construction, disclosed in my prior U.S. Pat. No. 4,498,413, the disclosure of which is incorporated herein by this reference, involves the use of an inflatable blader or a plurality of such bladders inside a shroud and arranged around and above the periphery of a rigid hull module. Such shroud may be attached removably to such rigid hull module by means of a boltrope, as disclosed in my co-pending application Ser. No. 618,147, filed June 7, 1984, the dislosure of which is incorporated herein by this reference, in which case the resulting aquatic vessel is modular. As such, the rigid hull portion is one module, the shroud is another module, and the bladder or bladders is or are another module or modules. The bladders may be attached and/or positioned by provision on or through the shroud, or on or through the rigid hull module. While the products made according to the aforereferenced disclosures of mine are advantaged, that is not to say improvement thereof is not possible.

Others have disclosed inflatable stuructures around and about the periphery of a rigid hull section, in which cases the complex-shaped structure or structures are air-containing vessels which, typically, are made of supported rubber or unsupported plastic film adhesively fastened to longitudinal straps which are adhesively or mechanially fastened to the rigid hull portion. Most mechanical fastenings, such as screws, bolts, rivets, eyes, grommets, lashings, lacings, concentrate stress between the rigid and flexible hull portions at points, increasing the probability of failure of the material and/or fastening at the points of attachment. The present invention is an advantageous way to attach continuously along lines such inflatable structures, as well as shrouds surrounding inflatable bladders, to a rigid hull portion; and the result is modular and readily assembled and disassembled for shipping, warehousing, nesting, storage, replacement of one or more modules, and/or repair of one or more modules.

In the case where a boltrope is used to attach the rigid hull module to the flexible portion, the rigid hull portion, usually at or near its periphery and at or just above the waterline, is provided with a C-sectioned channel which is open at at least one end to receive one end of the boltrope of the shroud module or inflatable member or members.

While such channel arrangement provides secure retention of the boltrope and the stresses between the rigid and inflatable portions of the boat are distributed along a line rather than concentrated at points, the complex shape of the flexible portion causes difficulty when the boltrope of the flexible portion is "threaded" into and along most or all of the length of the mating channel. The sharper the bends, or the more acute the angles, on the periphery, the greater the difficulty. Also, as the channels become dirty, corroded, the host for marine growth, and damaged, the threading task becomes more difficult.

It is, therefore, an object of the present invention to provide for a structure for a rigid inflatable vessel for which assembly and disassembly will be vastly facilitated for all categories of users and/or of which the shape will be vastly less limited by the shapes of the flexible-portions and their attachment means. Moreover, this invention will provide a construction which retains or provides line loading of the stresses between the rigid and flexible hull portions and distributes such stresses over a larger area of the rigid hull portion.

According to the principles of this invention, the rigid hull module, usually at or near its periphery and at or just above the waterline, is provided with a C-section peripheral channel for receiving the outer of two boltropes along most or all of the length of the flexible hull portion. Such peripheral channel extends most or all the way around the vessel, transoms in the cases of power boats being a notable and obvious exception wherebeyond the flexible portion typically extends equally on both sides of the boat but wherealong the flexible position does not continue. Such flexible portion has a second, inner boltrope, generally parallel to and the same length as said outer boltrope. While said inner and outer boltropes may be either the same size and materials or different sizes and made of different materials, or positions on the same or different horizontal plane or planes, it is often to make them alike. A plurality of discrete C-section inner channel members are provided which, after threading the desired number of them in the desired sequence onto and essentially all along said inner boltrope, are each removably attached to the rigid hull module generally before inflation and along a line inside of, parallel to, and most or all of the distance along the said peripheral channel. Each inner channel member may be either attached to the rigid hull module at a single point or multiple points on that member, or on a line along some or all its length. Removeable attachment of each inner channel member to the rigid hull module may be by screw of screws, bolt or bolts, hook or hooks, eye or eyes, rope tie or ties, rope lashing or lashings, shock cord tie or ties, shock cord lashing or lashings, or other suitable means. Said inner channel members may be some or all of the same or different lengths, straight or curved, and attached to the rigid hull portion by the same or different means; design features which may be varied to suit a particular vessel requirement. In cases where bladders are used, typically the bladders are affixed to the shroud module or rigid hull module before the inner channel members are removably attached to the rigid hull module; but not necessarily, because an advantage of this present invention is that one or some inner channel members may be dis-attached in order to gain access to a nearby wholly or partially deflated bladder or bladders without deflating all the bladders or disassembling the entire modular vessel. In addition to dividing the stresses between the rigid and flexible hull portions over two boltropes and a larger area of the rigid hull module, two boltropes and their mating C-section channels can afford a space therebetween wherein manifold pipes or tubes for the purpose of inflating and/or deflating the bladders can reside the the protection of the shroud module and/or the rigid hull module. After said inner channel members are threaded onto the inner boltrope, they may be flexibly or rigidly attached to each other at their ends, merely snugged together, or gaps may remain between them; and their ends may or may not have mating means. The result is a segmented channel line for holding the inner boltrope in the desired position. From the description that follows, it will be apparent to those skilled in this art that separate and generally parallel boltropes can provide better control over the position of the flexible hull portion relative to the rigid hull portion than attachment at points of continuously along a line, and more useful sole area can be a result. It can be advantageous to use adhesive bonding in place of the peripheral boltrope and mating C-section channel along with the inner boltrope and channel members disclosed hereinabove.

The foregoing and other advantages will become apparent as consideration is given to the following detailed description taken in conjunction with the accompanying drawings wherein:

BRIEF DESCRIPTION OF THE DRAWINGS

FIG. 1 is a schematic illustration of a plan view of the rigid hull module with an affixed peripheral C-section channel, inner channel members, and the flexible portion of the vessel of the present invention;

FIG. 2 is a detailed sectional and elevational view of a portion of the attachment means for the inner and outer boltropes for the shroud module and a bladder enclosed thereby to the rigid hull module of the present invention;

FIG. 3A is a perspective view of one of the discrete inner channel members used with the present invention;

DETAILED DESCRIPTION OF THE INVENTION

Figure 3B:
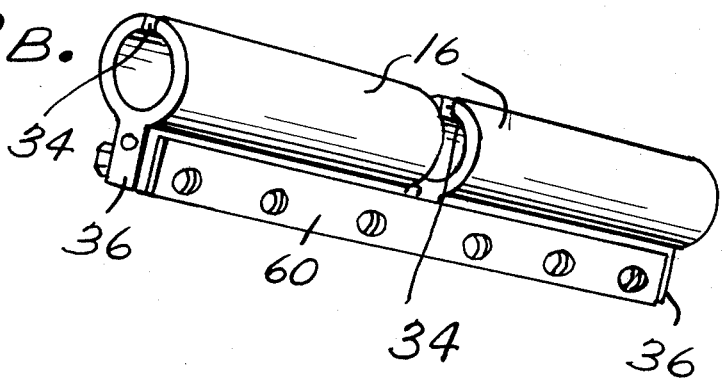
FIG. 3B is a perspective view of another arrangement of the discrete channel members of the present invention.

Referring now to the drawings, wherein like numerals designate corresponding parts throughout the several views, there is shown in FIG. 1 a schematic top plan view of an arrangement of a modular rigid inflatable boat 10 of the present invention. The boat 10 will have a rigid hull module 12 which may be of any seaworthy configuration and will include a sole or floor 13 and a topside 28 which is often of relatively low elevation above the sole.

About the periphery or upper portion of the topside 28 in these types of vessels, a boltrope-mating peripheral channel 24, as described below, is mounted for retaining shroud 18. According to the present invention, inside the peripheral channel 24 of the boat 10 a number of inner channel members 16 are also arranged as illustrated to assist in assembly and disassembly of the shroud 18 to and from the rigid hull module 12.

Referring now to FIG. 2, a specific embodiment of the construction of the present invention is illustrated. In FIG. 2, the peripheral channel 24 is positioned near the periphery 25 of the topside 28 and is preferably permanently secured by bolts, adhesives, rivets, welding or the like to the interior or exterior surface of the topside 28. It will be understood by those skilled in the art that a great variety of different means for fastening the peripheral channel 24 may be utilized in this field. In the present construction, the peripheral channel 24 is generally C-shaped in cross section and is provided with a slot 32 along its entire length. As mentioned above, channel 24 will extend around substantially the entire periphery of the rigid hull module 12 and may be formed partially or wholly integrally therewith where the rigid hull module is constructed from moldable material such as certain plastics or fiberglass. The slot 32 and interior surface of the channel should, of course, be rounded and smooth to provide lubricity and to prevent undue or uneven wear on the exterior of the boltrope 22, as will be apparent to those skilled isn the art.

The shroud 18 may be made of any suitably-resistant material such as the materials disclosed in my copending application incorporated herein by above reference. In the present invention, the shroud 18 may have a generally rectangular configuration although rounded to accommodate the radius at the prow of the rigid hull module 12. The opposite edges of the shroud 18 are provided with inner and outer boltropes 20 and 22, respectively, which extend preferably the entire length of shroud 18.

As mentioned above, the present invention utilizes a plurality of discrete inner channel members 16, one of which is illustrated in perspective view by FIG. 3A. Each of the inner channel members 16 is generally C-shaped in cross section and has a slot 33 and internal dimensions suitable for threading and retaining inner boltrope 20, respectively. The slot 33 is generally opposite to a mounting flange 36, which has holes 38 to facilitate fastening each inner channel member 16 to the rigid hull module 12 as described below. Referring again to FIG. 2, as shown, one of the inner channel members 16 is mounted along a portion of the boltrope 20 which is disposed on an edge of the shroud opposite the edge to which outer boltrope 22 is attached. The interior of the rigid hull module 12 will be provided, preferably at regular intervals, with anchoring means such as hooks or eyes 42 for receiving a lashing member or attachment device 40, the opposite end of which connects as associated inner channel member 16 to the interior of the rigid hull module 12 as illustrated. Since the size of each of the slots 32 and 33 is selected so that neither of the respective boltropes 20 or 22 can pass transversely through the associated slot in the respective channel member, the boltropes when under load tend to be continuously held in place once positioned in their desired locations.

As shown in FIG. 3A, the member 16 is provided with a small diameter bore 19 for receiving a rod or pin which will extend through a number of aligned members 16 to stabilize them in use. In FIG. 3B, another stabilizing means is provided in the form of plates 60 which are bolted to the flanges 36 of two or more members 16 on one or both sides of the flanges 36.

Figure 4:
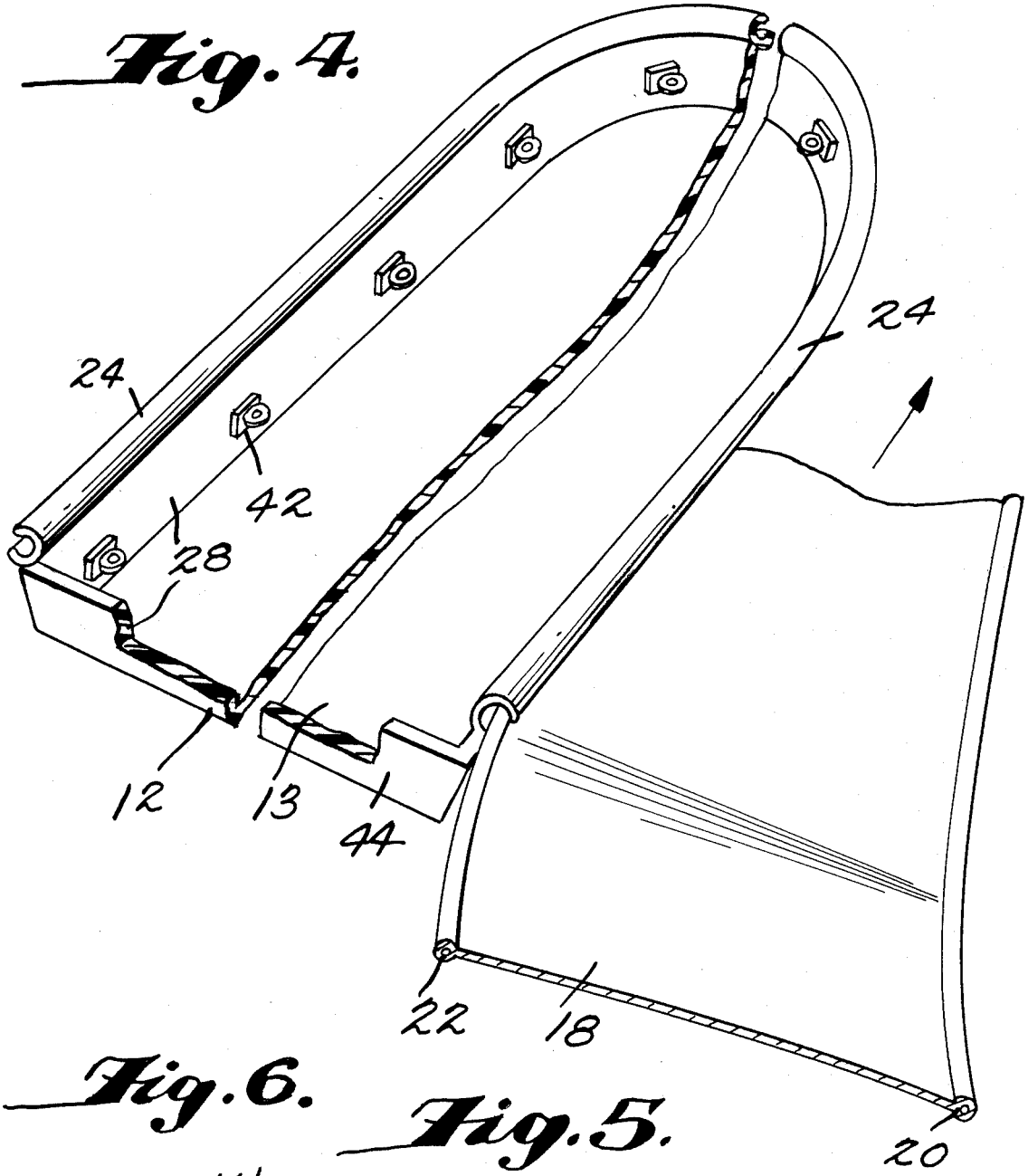
FIGS. 4 and 5 are schematic illustrations of the assembly and disassembly techniques utilizable with the principles of the present invention.
Figure 5:
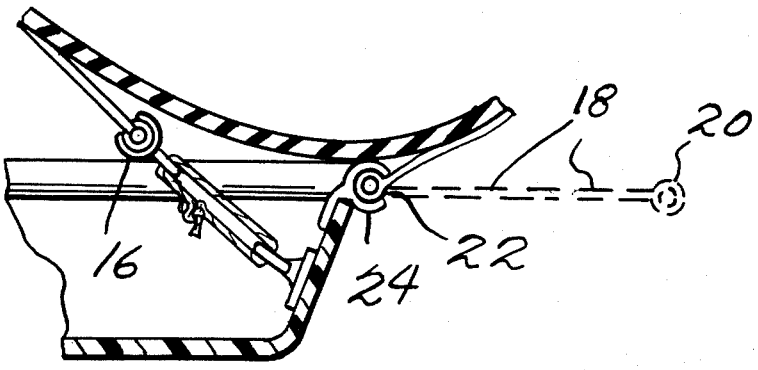

Referring now to FIGS. 4 and 5, assembly as well as disassembly of the construction will not be explained. As will be apparent from what follows, various alternatives will be apparent to those skilled in the art for disposing the inflatable members, such as the bladders disclosed in my copending application incorporated herein by reference within the shroud 18.

To assemble the modular rigid inflatable boat, a user preferably simply threads one end of one of outer boltrope 22 into one open end of peripheral channel 24 and then continue to feed outer boltrope 22 through the channel until the outer boltrope 22 extends completely around peripheral channel 24 and therefore completely around the periphery of the rigid hull module 12. Since no inflatable member need be present to encumber this operation, threading of the outer boltrope 22 of the essentially rectangular shroud 18 through the peripheral channel member 24 is significantly facilitated. Once the outer boltrope 22 has been threaded and fed the full length of the peripheral channel member 24, a user may, in either sequence he may elect, then proceed to thread the discrete inner channel members 16 onto the inner boltrope 20 and attach the individual bladders directly to what will become the interior of the shroud 18 in any suitable manner such as by fixing the bladder nipples through the shroud or the like. In another alternative, the user may simply employ the method of bladder insertion discussed in my prior U.S. Pat No. 4,498,413 wherein openings are provided in the shroud. In this arrangement, the user, after threading the discrete inner channel members onto the inner boltrope 20, will then effect securing of each discrete inner channel member 16 to the interior of the hull at fitting intervals as illustrated in FIG. 1. Thereafter, the inflatable bladders may be inserted through the provided openings in the shroud 18 and then inflated to fully occupy the cavity provided by the cavity defined by shrould 18. Such full occupancy prevents water from occupying said cavity and water from passing through the shroud into the boat.

A demountable or hinged transom may be provided above the rigid hull module and across the stern 44, or a fixed transom may be made integral with the rigid hull module 12.

Disassembly is simply the reverse of the process described above. For example, a user may deflate each of the bladders and release each of the individual channel segments 16 which will simultaneously release the cover member 18. The user will then recover the bladders for storage and then unthread the remaining outer boltrope 22 from the peripheral channel 24. Again, it will be noted, that since the shroud 18 can be unencumbered by the bladders and/or essentially rectangular after inner boltrope 20 has been de-attached from the rigid hull module 12, unthreading or removal of the outer boltrope 22 and therefore shroud 18 from peripheral channel 24 will be substantially simplified.

It will be apparent to those skilled in the art that any number of fastening alternatives may be employed to secure the discrete inner channel members 16 to the interior of the rigid hull module. Preferably, easily sized and attached devices such as loops, springs, shock cord, rope or shackles will be employed so that the ideal disposition of the shroud 18 relative to the orientation of the various channel slots will be effected to minimize chafing or concentrated wear on the boltropes 20 and 22 in the vicinity of the slots 32 and 33 of the respective channels.

In addition, while each of the various channels is preferably open at one or both its ends to facilitate sliding of the various boltropes in and out of the various channel, means may be provided to lock the various boltropes in position once located as desired along a length of the boltrope. For this purpose as shown in FIG. 6, and described below, clamping elements 17 are provided to lock a channel member to its mating boltrope where ever disirable.

From the foregoing, it should be apparent that the combination of a shroud with the parallel boltropes along parallel edges of that shroud will permit designers of the hulls utilizing these constructions a much wider design latitude than has heretofore been practical. For example, the prow may be shaped virtually as sharp as desired without undue concern for the ability of a user to effect installation of the shroud and therefore of the inflatable members of such a design. In addition, the use of the discrete inner channel members 16 will afford the designer of the interior of the vessel substantially greater latitude since individual and selected inner channel members 16 can be shifted or eliminated to permit the installation of other equipment or accommodations for the users.

Figure 6:
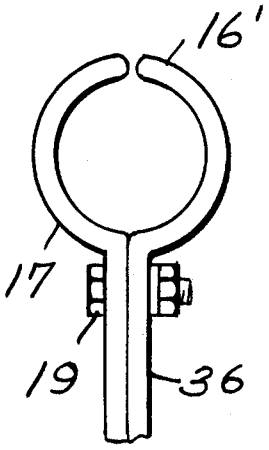
FIG. 6 is side elevational view of a portion of a channel segment of the present invention.

In a further embodiment of FIG. 6, a discrete channel member 16 may be made in two parts to facilitate its clamping along a chosen sector of boltrope 20. For example, one side 17 of the C-section channel member may be removably attached to the flange portion 36 by means of the bolt and nut 19 or the like. This arrangement has the advantage that when the removable piece is installed it can be suitably tightened to lock the channel segments 16 on the boltrope, as mentioned above. This has the advantage that loss of the discrete channel members will be prevented since each member can remain attached at a chosen location to the associated boltrope even when the bladders are deflated and the shroud removed from the hull. Moreover, undue chafing or rubbing of the shroud material can be minimized with this arrangement.

Figure 8:
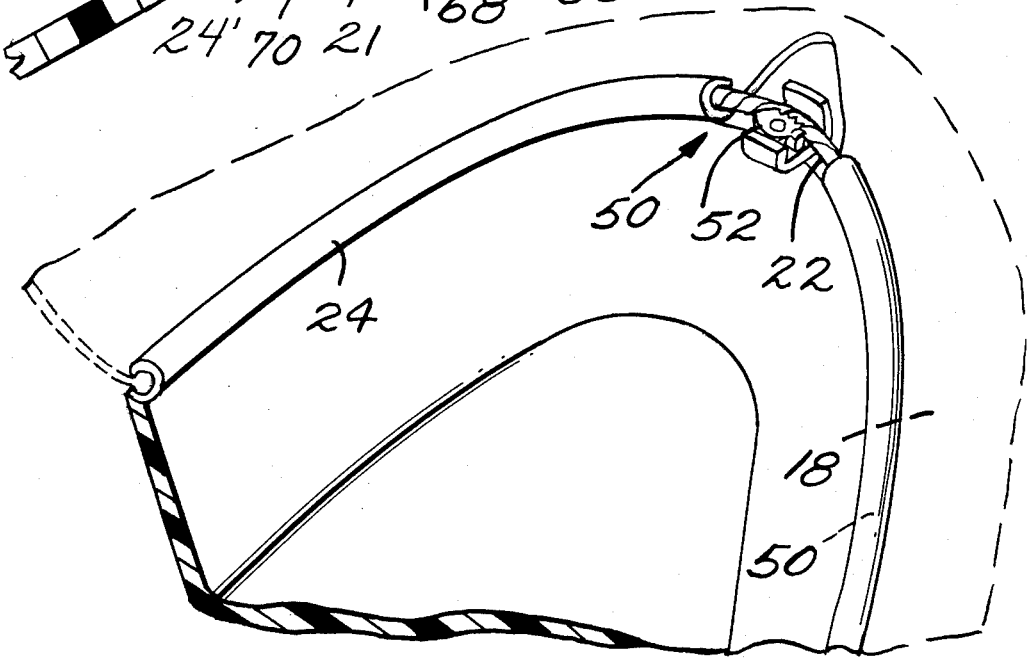
FIG. 8 is an alternate arrangement of the retaining means for one of the bolt ropes where the periphery of the vessel includes a sharp angle.

As shown in FIG. 8, the peripheral channel 24 can have one or more segments 50 of the inner portion of its C-section wall removed to facilitate threading the outer boltrope 22 thereby, particularly where the removed segments are along a tight curve or angle on the peripheral channel 24, such as at the prow. As replacement for removed segments of wall, appropriately-shaped clamps such as at 52 can be used to dual advantage: they can lock the boltrope to its mating channel along a chosen segment, and can avoid creating a chafe point at the ends of a cord between the ends of the walls remaining after a wall segment has been removed.

The space between outer and inner pairs of boltropes and their mating channels can be used advantageously as shown in FIG. 2 for positioning protectively manifold tubes 55 serving bladders or other inflatable members and/or for the ends of manifold pipes made an integral part of the rigid hull portion. Clamps 59 may be used to anchor the tube 55 in place. In cases where any bladder or some or all bladders expand to fill this space, a protective flap or cover 56 may be positioned between the bladder or bladders and any object with which it or they may come into contact.

Referring again to FIGS. 3A and 3B, the ends of the discrete inner channel members can be fitted with internal positioning/connecting pins or external plates 60 or other means to avoid concentration of loads where unconnected channel members are butted together.

Figure 7:
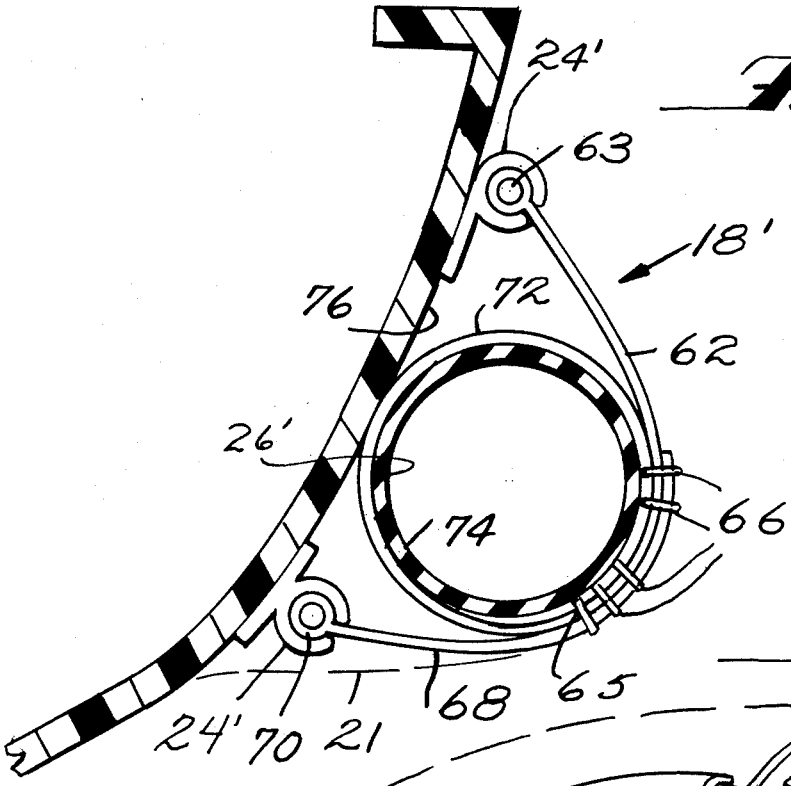
FIG. 7 is a sectional view partly in elevation with parts broken away of another arrangement of the shroud and bladders of the present invention.

Relatively low topsides have an advantage in that, by deflating one or more inflatable members, easier access is provided to a task in or near the water, such as retrieval of a man or object from the water. But, for application to vessels that have topsides that rise relatively far above the water, an inflatable portion may be added outside those topsides, as schematically shown in FIG. 7. In these cases, the aforementioned outer boltrope-peripheral channel arrangement 24' is positioned at or near the waterline 21 and the inner boltrope-inner channel members are mounted thereabove, and either a chafe piece of textile or plastic material along the bladder- or bladders-bearing area of the topsides or a shroud that envelopes the bladders 26' 360 degrees is often used as a means to prevent wear resulting from the bladders rubbing and moving against the topsides. One such form of the shroud is shown in FIG. 7.

Referring to FIG. 7, the shroud 18' includes a first flexible sheet section 62 which has along one edge the usual boltrope 63. The opposite edge 65 of sheet 62 is wrapped 360 degrees about an axis and then sewn to a section of the sheet 62 intermediate the ends 63 and 65. In addition, this stitching is used to secure the intermediate section, generally indicated at 66 in FIG. 8, to a portion of a second sheet 68 of the shroud 18' with this second sheet 68 terminating in a boltrope 70. With this arrangement, a tubular flexible envelope 72 is defined within the shroud 18' and it is in this envelope 72 that inflatable bladders 74 may be situated. It will be clear that the envelope 72 will protect the bladders from chafing against the external hull 76 of the vessel during use.

Having described the invention, it will be apparent to those skilled in the art that various modification may be made thereto without departing from the spirit and scope of this invention and without departing from the appended claims.

What is claimed is:

1. In combination with a rigid hull portion of an aquatic vessel, where said hull portion has a periphery surrounding at least a substantial portion of said vessel, a first retaining means disposed along a substantial portion of said hull in the vicinity of said periphery for retaining a plurality of inflatable means generally at or above the waterline of said vessel, said vessel having second retaining means spaced from said first retaining means for detachably holding said inflatable means in a selected positon relative to said vessel, said second retaining means including means for adjustably and releasably attaching said second retaining means to said vessel independent of said first retaining means whereby the position of said second retaining means can be altered relative to said vessel and said first retaining means.

2. The invention as claimed in claim 1 wherein said inflatable means includes a cover means having spaced apart segments, said segments having means for cooperating with said respective retaining means.

3. The combination of claim 2 wherein said segments extend in substantially spaced parallel relation to one another.

4. The combination of claim 3 wherein said cooperating means of said segments are boltropes.

5. The combination of claim 2 wherein one of said segments is an edge of said cover means.

6. The combination of claim 5 wherein the other of said segments is an opposite edge of said cover means.

7. The combination of claim 5 wherein said cooperating means of said segments are boltropes.

8. The combination of claim 2 wherein said cover means is a fabric.

9. The combination of claim 2 wherein said cover means is sheet material.

10. The combination of claim 2 wherein a space is provided between said first and second retaining means and flexible means are inserted between said retaining means across said space.

11. The combination of claim 2 wherein said inflatable means includes bladders and said cover means are dimensioned so that said bladders are disposed serially about said periphery in said cover means when said cover means locates and holds said bladders in said selected position.

12. The combination of claim 2 wherein said cooperating means of said segments are boltropes.

13. The combination of claim 2 wherein said first retaining means is a channel member extending about said periphery.

14. The combination of claim 13 wherein said channel member has open opposite ends.

15. The combination of claim 13 wherein said channel member has an open slot coextensive therewith through which said cover means can extend but which prevents passage of said cooperating means of said respective segment.

16. The combination of claim 13 wherein said channel member is substantially C shaped in cross-section.

17. The combination of claim 13 wherein each cooperating means includes a boltrope and each said boltrope has opposite ends and said channel member has open opposite ends of a size to permit insertion of an end of a said boltrope.

18. In combination with a rigid hull of a boat, said hull having a periphery surrounding at least a substantial portion of said boat, a plurality of buoyant means, a flexible cover means for substantially enclosing said buoyant means, said cover means having two spaced, substantially parallel edges, each said edge including a cooperating means along at least a portion thereof, said hull including anchoring means for detachably engaging and holding one of said cooperating means of an edge of said cover means on said hull and positioning means for detachably engaging said cooperating means of the other said edge of said cover means independently of said anchoring means so that said cover means will locate and hold said buoyant means in a selected adjustable position relative to said hull of said boat, said cover means including a first sheet having one of said edges and a separate edge wrapped onto and secured to said first sheet to form an envelope, a second sheet having a separate edge fastened to said first sheet and having the other of said edges for cooperating with said anchoring means, said buoyant means comprising inflatable bladders with said bladers being disposable in said envelope and separated from said hull by a portion of said first sheet.

19. In combination with a rigid hull of a boat, said hull having a periphery surrounding at least a substantial portion of said boat, a plurality of buoyant means, a flexible cover means for substantially enclosing said buoyant means, said cover means having two spaced, substantially parallel edges, each said edge including a cooperating means along at least a portion thereof, said hull including anchoring means for detachably engaging and holding one of said cooperating means of an edge of said cover means on said hull and positioning means for detachably engaging said cooperating means of the other said edge of said cover means independently of said anchoring means so that said cover means will locate and hold said buoyant means in a selected adjustable position relative to said hull of said boat, said positioning means comprising a C-shaped channel member extending substantially about said periphery and which is interrupted along its length and said retaining means is a boltrope, said hull including a guide means for engaging said boltrope to restrain movement of said boltrope from a line defined by said channel member.

20. In combination with a rigid hull portion of an aquatic vessel, where said hull portion has a periphery surrounding at least a substantial portion of said vessel, a first retaining means disposed along a substantial portion of said hull in the vicinity of said periphery for retaining a plurality of inflatable means generally at or above the waterline of said vessel, said vessel having second retaining means spaced from said first retaining means for detachably holding said inflatable means in a selected position relative to said vessel, said second retaining means comprising a plurality of anchor means, each said anchor means comprising a channel section member having a length substantially less than the length of said first retaining means.

21. The combination of claim 20 wherein each said channel section member is detachably secured to said hull portion on the interior thereof.

22. The combination of claim 21 wherein a fluid supply conduit is attached to the interior of said hull between the point where said channel section members are attached to sid hull portion and said first retaining means.

23. The combination of claim 20 wherein means for joining together adjacent said channel section members are provided.

24. The combination of claim 20 wherein securing means are provided for each said channel section member.

25. The combination of claim 20 wherein said channel section member is detachably secured to said hull portion on the interior thereof.

26. The combination of claim 25 wherein a fluid supply conduit is attached to the interior of said hull between the point where said channel section members are attached to said hull portion and said first retaining means.

27. The combination of claim 20 wherein means for joining together adjacent said channel section members are provided.

28. The combination of claim 20 wherein securing means are provided for each said channel section member.

29. The combination of claim 28 wherein said securing means are flexible cable lengths.

30. In combination with a rigid hull portion of an aquatic vessel, where said hull portion has a periphery surrounding at least a substantial portion of said vessel, a first retaining means disposed along a substantial portion of said hull in the vicinity of said periphery for retaining a plurality of inflatable means generally at or above the waterline of said vessel, said vessel having second retaining means spaced from said first retaining means for detachably holding said inflatable means in a selected position relative to said vessel, said second retaining means including means for adjustably and releasably attaching said second retaining means to said vessel independent of said first retaining means whereby the position of said second retaining means can be altered relative to said vessel and said first retaining means, said inflatable means including a cover means having spaced apart segments, said segments having means for cooperating with said respective retaining means, said first retaining means comprising a channel member extending about said periphery of said hull portion, said channel member being interrupted along its length and said cooperating means being a boltrope, said hull including a guide means for engaging said boltrope to restrain movement of said boltrope from a line defined by said channel member.

* * * * *